US005487805A

United States Patent [19]

Boriani et al.

[11] Patent Number: 5,487,805

[45] Date of Patent: Jan. 30, 1996

[54] METHOD AND A DEVICE FOR THE AUTOMATIC SPLICING OF STRIPS DECOILED FROM ROLLS

[75] Inventors: Silvano Boriani; Antonio Gamberini, both of Bologna, Italy

[73] Assignee: G.D S.p.A., Bologna, Italy

[21] Appl. No.: 216,845

[22] Filed: Mar. 24, 1994

[30] Foreign Application Priority Data

Mar. 25, 1993 [IT] Italy ..... BO93A0112

[51] Int. Cl.[6] ..... B65H 21/00

[52] U.S. Cl. ..... 156/159; 156/504; 156/505; 156/509; 242/552; 242/554.2; 242/554.5; 242/556.1

[58] Field of Search ..... 156/157, 159, 156/504, 505, 506, 502, 509; 242/552, 554.2, 554.5, 556, 556.1

[56] References Cited

U.S. PATENT DOCUMENTS

| | | | |
|---|---|---|---|
| 3,227,594 | 1/1962 | Ryan | 156/159 |
| 4,120,739 | 10/1978 | Peeters et al. | 156/506 |
| 4,566,922 | 1/1986 | Martinez | 156/506 X |
| 4,629,531 | 12/1986 | Kataoka | 156/159 X |
| 4,840,694 | 6/1989 | Brookman et al. | 156/157 X |
| 4,842,681 | 6/1989 | Bader et al. | 156/504 |
| 4,878,982 | 11/1989 | Ogata et al. | 156/505 X |
| 4,878,986 | 11/1989 | Nishikawa | 156/504 |

FOREIGN PATENT DOCUMENTS

| | | | |
|---|---|---|---|
| 804998 | 1/1969 | Canada | 156/505 |
| 0162371 | 11/1985 | European Pat. Off. | B65H 19/18 |
| 1199922 | 7/1970 | United Kingdom | B65H 19/20 |
| 1316062 | 5/1973 | United Kingdom . | |
| 1333083 | 10/1973 | United Kingdom | B65H 21/00 |
| 1415112 | 11/1975 | United Kingdom | B65H 21/00 |
| 2091222 | 8/1982 | United Kingdom | B65H 19/18 |
| 2189226 | 10/1987 | United Kingdom | B65H 21/00 |
| 2254316 | 10/1992 | United Kingdom | B65H 19/10 |

*Primary Examiner*—Mark A. Osele
*Attorney, Agent, or Firm*—Cushman Darby & Cushman

[57] ABSTRACT

Continuous strip materials supplied in rolls are spliced automatically at the moment of use by a series of steps in which the leading end of the strip decoiled from a new roll is arranged first on the locating and striking face of a suction bar capable of movement between an at-rest position and a splicing position, whereupon the trailing end of the depleted strip decoiling from the roll still in use is restrained against a fixed reference surface coinciding with the splicing position, a transverse cut made through the trailing end of the depleted strip, and the leading end of the new strip brought into contact with the area of the trailing end of the depleted strip terminating in the cut, and the joined ends are then secured by heat-sealing or by applying an adhesive or a double-sided sticker.

11 Claims, 3 Drawing Sheets

1
2
3
5
5a
8
10
15
17
18
19
22
23
24
26
27
29
35
43
44
45

1
2
3
5
6
9
10
10a
12
13
14
15
16
17
18
19
20
21
22
23
24
26
27
29
34
35
37
38
39
39a
39s
40
41
42
43

METHOD AND A DEVICE FOR THE AUTOMATIC SPLICING OF STRIPS DECOILED FROM ROLLS

BACKGROUND OF THE INVENTION

The present invention relates to a method by which strips unwound from rolls are joined automatically. In the field of automatic power machines, for example, wrapping machines which utilize paper or heat-sealable strip material wound onto rolls, the need exists for one depleting roll to be replaced by a new roll without any break in continuity of the strip feed, as this would be unacceptable for correct operation of the wrapping machine.

Among the more pressing problems requiring solution in an automatic power machine of the type mentioned above is, therefore, the question of how an automatic splice may be made swiftly and accurately between the trailing end of a depleted roll of strip material and the leading end of a new roll of strip material. The prior art embraces numerous devices capable of effecting such an operation, though these tend invariably to be complicated, and therefore costly.

UK patent No. 1 316 062 discloses a splicing method that consists in affixing the leading end of a new strip to a first roller by means of an adhesive tab and then bringing the roller to bear tangentially against a guide roller over which the strip of the depleting roll runs during normal operation. Having thus positioned the roller, the depleting strip must be cut at a point preceding the splice in order to ensure that the remaining coils of the roll are not drawn into the machine together with the new strip. The cut must necessarily be made at a certain distance preceding the point at which the adhesive tab is brought to bear, so as to prevent the blade from entering into contact with the two rollers and with the leading end of the new strip. It is therefore typical of a roll changer device as outlined above that, on completion of the splicing operation, one is left with a double thickness of strip which appears relatively long when compared with the dimensions of the adhesive tab, and more particularly, with a substantially free length of material (restrained only at one end), namely the final waste portion of the fully depleted roll of strip, occupying an area near to where the splicing operation takes place.

This same free length of material can give rise to significant drawbacks, proving difficult to control as the strip is advanced, and, during subsequent operations by which the continuous strip is divided into single wrapping sheets, generating duplicate sheets of waste material that can impede correct operation and even cause the machine to shut off altogether.

The object of the present invention is to provide a method of splicing two strips automatically, both inexpensively and without the drawbacks mentioned above.

SUMMARY OF THE INVENTION

The stated object is fully realized in a method of splicing strips automatically according to the present invention which comprises the steps of: locating the leading end of the strip decoiled from a new roll on retaining means capable of movement between a receiving limit position, in which the leading end of the new strip is admitted, and a splicing limit position at which a step effected subsequently in conjunction with a fixed reference surface results in the leading end of the new strip being joined to the trailing end of a depleting strip decoiled from a roll currently in use; temporarily restraining the trailing end of the depleted strip against the fixed reference surface; effecting a transverse cut through the trailing end, in conjunction with the reference surface; offering the leading end of the new strip in direct contact to the terminal portion of the trailing end created by the transverse cut, still restrained against the fixed reference surface, such that the leading end of the new strip and the trailing end of the depleted strip remain joined together. The invention also relates to a device suitable for the implementation of the method outlined above, comprising: a fixed reference surface over which the depleting strip is advanced; restraint means capable of movement between two limit positions and serving to hold the trailing end of the depleting strip motionless on the fixed reference surface; cutting means capable of movement between two limit positions and designed to effect a transverse cut through the trailing end by interaction with the reference surface; movable retaining means capable of transferring from a receiving limit position, in which the leading end of the new strip is located in readiness, to a splicing limit position in which the selfsame leading end is offered flush against the reference surface and joined to the portion of the trailing end of the depleted strip created by the transverse cut; and means of securing a joint between the leading end and trailing end, operating in conjunction with and within the compass of the retaining means.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
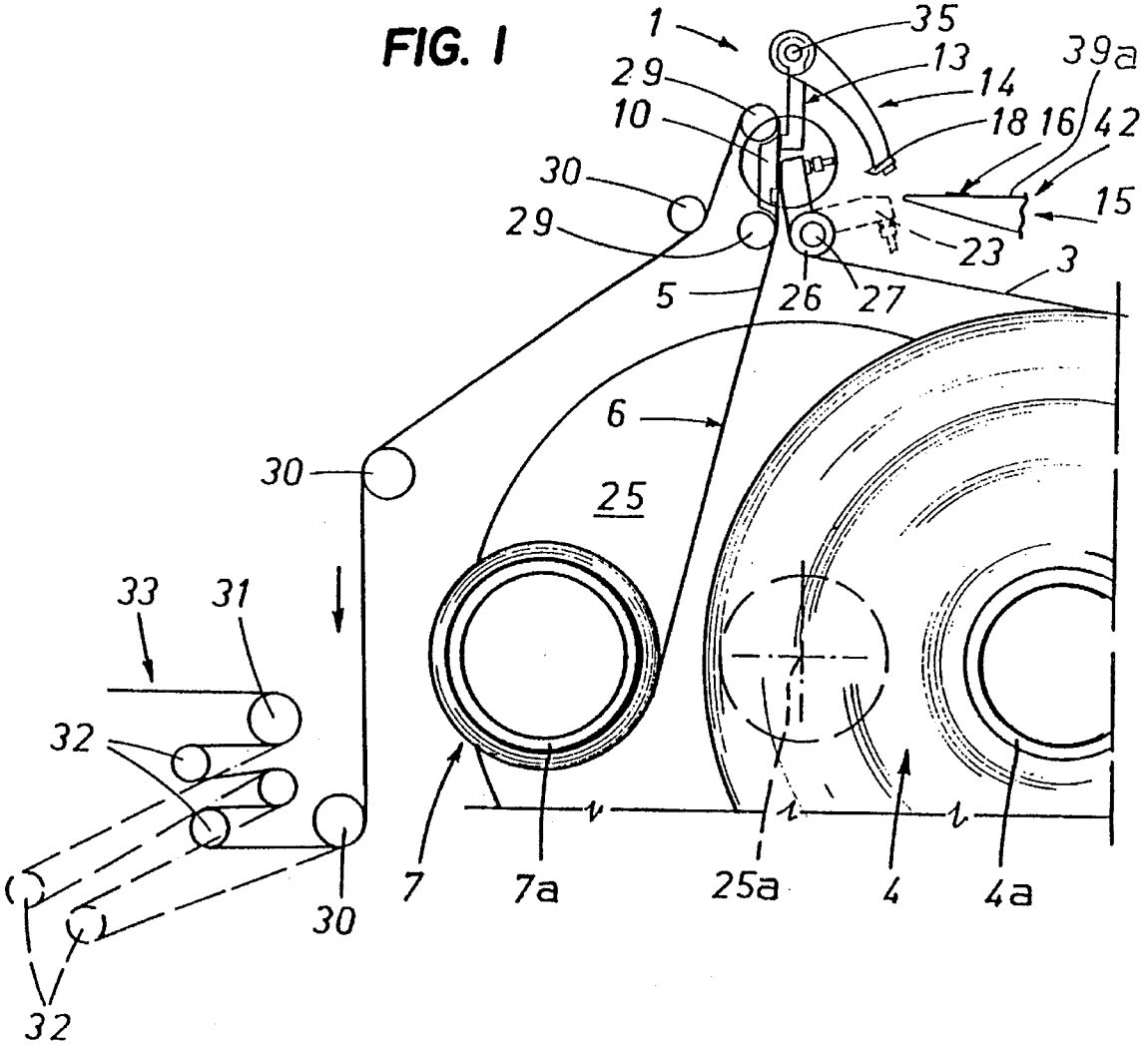
FIG. 1 is a schematic elevation of the device to which the present invention relates, viewed in an operating configuration that results in two strips being spliced together.
Figure 1A:
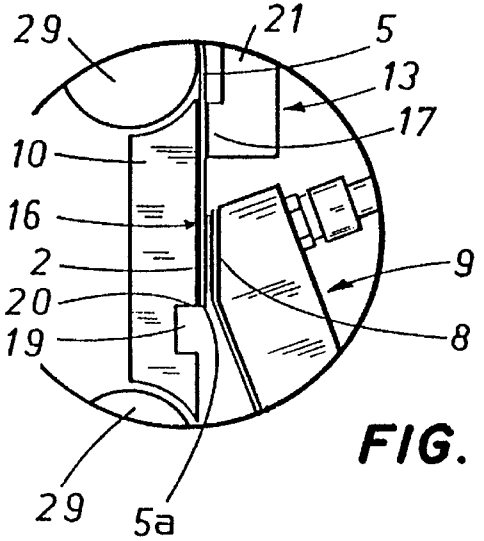
FIG. 1A is a larger scale fragmentary evaluation of the detail encircled at a middle upper region of FIG. 1.

An automatic splicing method suitable for strips of material decoiled from rolls comprises a first step (shown in FIG. 3), in which the leading end 2 of a new continuous strip 3 decoiled from a new roll 4 is positioned on the locating and striking face 8 of retaining means, denoted 9, capable of movement between an at-rest limit position and a splicing limit position; a second step (FIG. 4) in which the trailing end 5 of a depleted strip 6 decoiling from a roll 7 currently in use is restrained against a fixed surface 10 afforded by a relative bar 10*a* and functioning as a reference element for the locating and striking face 8; a third step of cutting the depleted strip 6 transversely at a point preceding the area in which the relative trailing end 5 is restrained against the fixed reference surface 10; and a fourth step (see FIG. 1) in which the leading end 2 of the new strip is brought into contact with the terminal portion of the trailing end 5 of the depleted strip 6, resulting from the transverse cut effected previously, and the two ends 2 and 5 are joined together. Contact between the leading end 2 and the trailing end 5 is brought about by causing the retaining means 9 to assume the splicing limit position, in which the locating and striking face 8 lies flush against the fixed reference surface 10. Such a method is implemented by means of a device 1 incorporating the fixed reference surface 10, over which the depleting strip 6 is made to pass when decoiling. Also operating in conjunction with the fixed reference surface 10, besides the retaining means 9 and its locating and striking face 8, are means 13 by which to restrain the trailing end 5 of the depleted strip 6, means 14 by which to cut the restrained trailing end 5, and means 15 of effectuating a joint between the leading end 2 of the new strip 3 and the trailing end 5 of the depleted strip 6. The new and depleted rolls 4 and 7 are both carried by a support 25 in the form of a disc, rotatable about a horizontal axis 25*a* disposed parallel with the cores 4*a* and 7*a* of the rolls 4 and 7.

Figure 2:
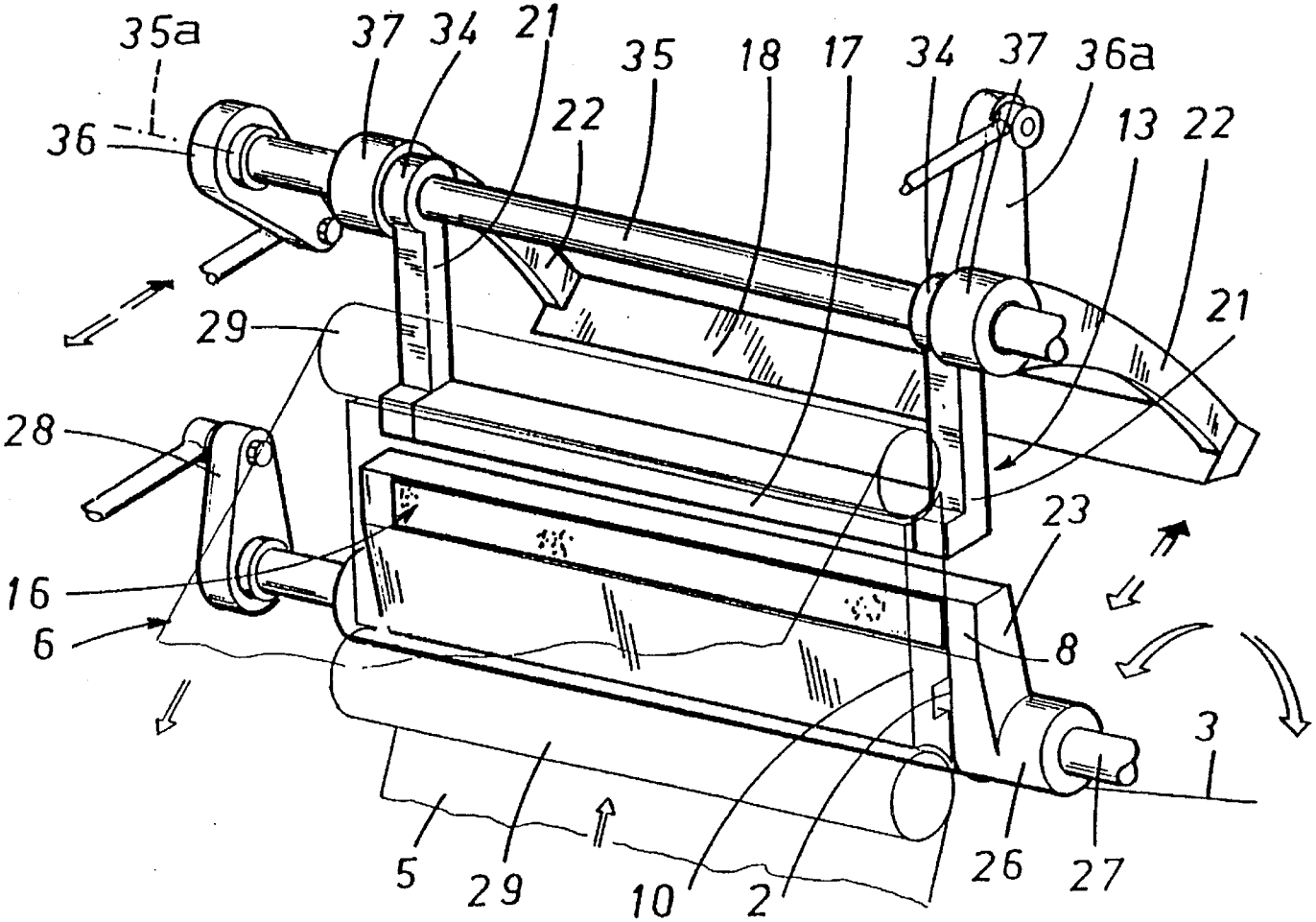
FIG. 2 shows the device of FIG. 1 in perspective, with certain parts omitted better to reveal others.

The retaining means 9 occupies a position above the support 25 and consists essentially in a suction bar denoted 23, of which the part uppermost affords the locating and striking face 8. Suction is generated through a plurality of holes 24 distributed along the length of the bar 23 (see FIG. 2), emerging onto the locating and striking face 8 and connected to a source of negative pressure not illustrated in the drawings. The suction bar 23 is keyed by way of a substantially cylindrical extension, denoted 26, to a mounting and actuating shaft 27 disposed parallel with the horizontal axis 25*a* of the disc 25. Also illustrated in FIG. 2 is a lever 28 connected by one end to a corresponding extremity of the mounting and actuating shaft 27 and linked by the remaining end to transmission and drive components not shown in the drawings.

The suction bar 23 is rotatable about the mounting and actuating shaft 27, through the agency of the lever 28, between a receiving limit position and a splicing limit position in which the locating and striking face 8 lies respectively distanced from and in contact with the fixed reference surface 10. The joining means 15 might be of any given type, according to the nature of the strip material. In a first example, assuming the strips 3 and 6 to be of heat-sealable material, such joining means 15 would consist in heating means 12 embedded within the suction bar 23 (see FIG. 3).

Figure 4:
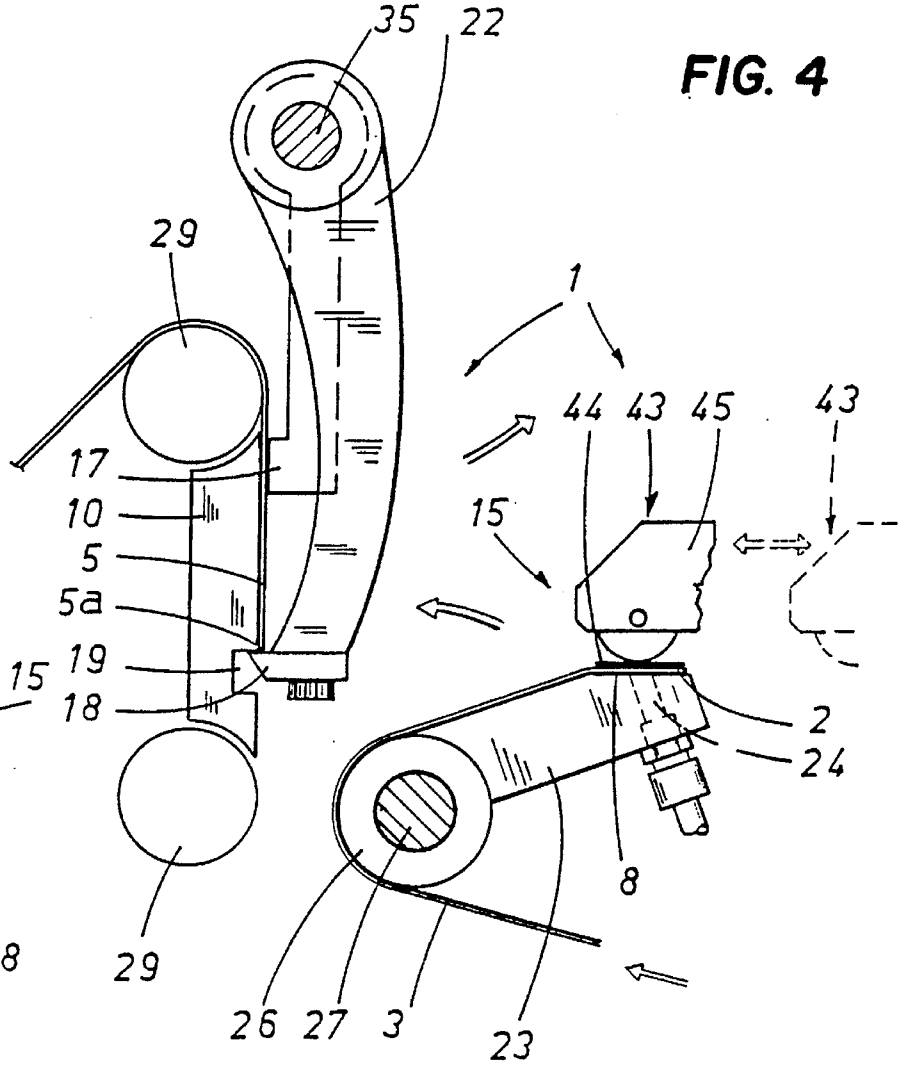
FIGS. 3 and 4 are two further schematic elevations which show the device, enlarged, in a sequence of two successive operating configurations preceding that of FIG. 1.
Figure 3:
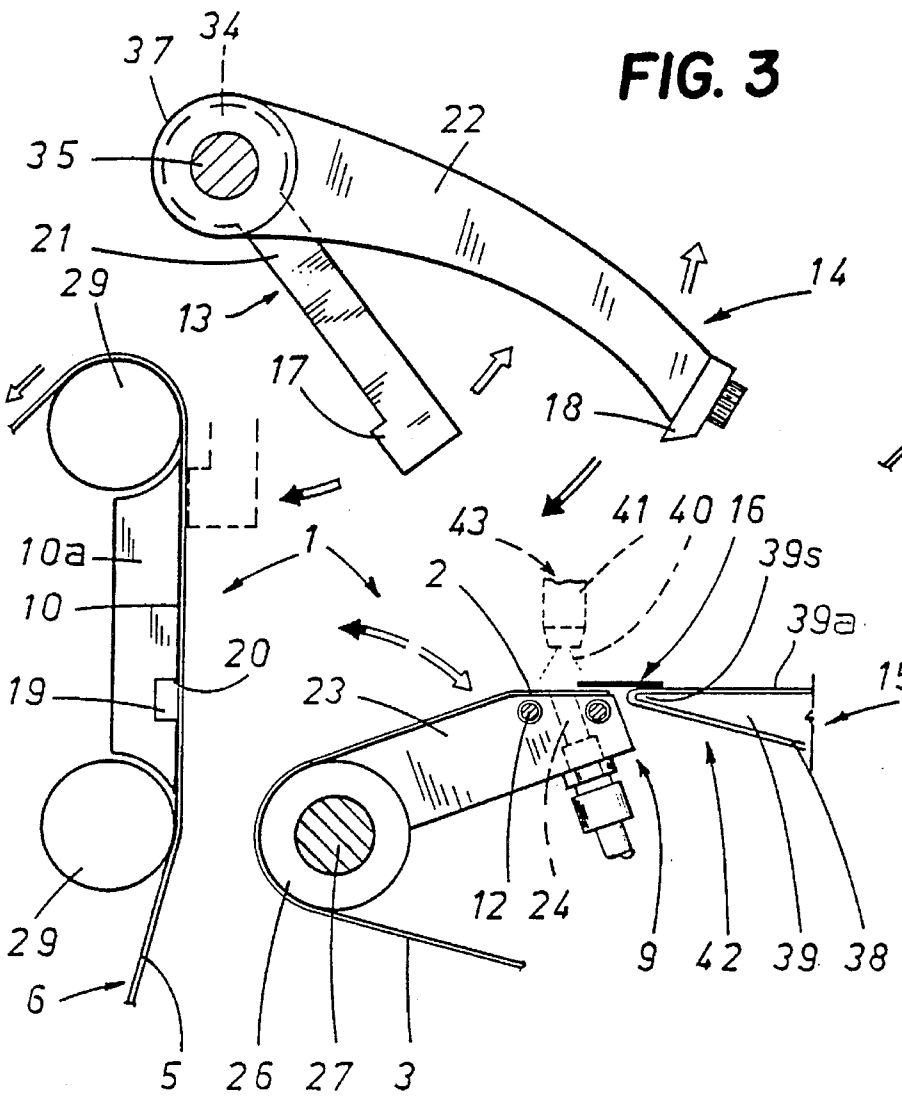

Alternatively, joining means 15 could take the form of means 42 designed to distribute fastening means such as double-sided stickers 16 (as illustrated in FIGS. 1 and 3), or means 43 capable of dispensing an adhesive substance denoted 40 in FIG. 3, where the dispensing means 43 are indicated by way purely of example as a nozzle 41 spraying liquid adhesive 40. In the example of FIG. 4, finally, such dispensing means 43 are shown as an applicator 45 designed to spread an adhesive material 44 of paste consistency directly onto the face of the leading end 2 of the new strip 3 destined to enter into contact with the trailing end 5 of the depleted strip 6. In the case of the double-sided stickers 16, these are shown advancing along a relative conveyor belt 38 looped over a reel (not illustrated) and passing around an element of wedge profile 39, of which the topmost face 39*a* occupies substantially the same plane as the locating and striking face 8 and the tapered extremity 39*s* lies adjacent to the suction bar 23 when in the receiving limit position (see FIG. 3). The aforementioned bar 10*a* is interposed between a pair of freely revolving guide rollers 29 disposed substantially tangential to the plane occupied by the fixed reference surface 10 on the side opposite from the suction bar 23.

The bar 10*a* exhibits a transverse channel 19 formed in the reference surface 10, disposed parallel with and adjacent to the lower of the guide rollers 29, and affording a fixed edge 20 uppermost that serves as a meeting blade for the cutting means 14. The decoiling strip 6 currently in use is directed over the guide rollers 29 and the fixed reference surface 10 interposed between the two rollers, then diverted over further freely revolving rollers 30 to a tension compensating system 33 of conventional embodiment comprising fixed position and jockey rollers, also freely revolving, denoted 31 and 32 respectively (see FIG. 1).

The restraint means 13 and cutting means 14 occupy a position above the retaining means 9. The restraint means 13 consist in a bar 17 disposed parallel to the suction bar 23, of which the two ends are rigidly associated with corresponding ends of a pair of mutually parallel arms 21 (see FIG. 2). The remaining ends of the two arms 21 are rigidly associated each with a corresponding boss 34, and the two bosses 34 keyed to an actuating shaft 35 of which the axis 35*a* is disposed parallel with the mounting and actuating shaft 27 of the retaining means, at a height above that of the upper guide roller 29 and that of the bar 17.

The actuating shaft 35 is connected to respective drive means (not illustrated) by way of a lever 36 keyed to one end. The same shaft 35 also carries two freely rotatable bosses 37 located externally of the two bosses 34 first mentioned, each rigidly associated with one end of a relative arm 22 that projects in a substantially radial direction from the boss 37. The remaining ends of the arms 22 are rigidly associated with the two ends of a blade 18 extending parallel to the actuating shaft 35 and constituting the cutting means 14. The blade 18 is capable of movement, transmitted by a lever 36*a* rigidly associated with one of the two bosses 37 and forming a part of drive means not illustrated in the drawings, between an at-rest limit position in which the cutting edge is distanced fully from the fixed reference surface 10, a cutting limit position in which the edge is in contact with the meeting edge 20 of the channel 19 afforded by the surface 10, and an intermediate position between the two limit positions.

Departing from a configuration with the restraint bar 17 and the blade 18 occupying their respective at-rest positions, the sets of arms 21 and 22 are caused by the levers 36 and 36*a* to rotate clockwise (as viewed in the drawings). This brings the bar 17 into the restraint position, and the blade 18 to the intermediate position (FIG. 1). The bar 17 then remains in the restraint position as long as is necessary for the blade 18 to describe one full oscillation from the intermediate position to the cutting position and back gain.

In an operating situation, the strip 6 is drawn forward by means (not illustrated) located beyond the tension compensating system 33. At this stage, the jockey rollers 32 are distanced from the fixed position rollers 31, as indicated by the phantom lines in FIG. 1. The restraint bar 17 and the blade 18 occupy their respective at-rest positions, and the suction bar 23 is positioned in readiness to receive the leading end 2 of the new strip 3. Once the operator has directed the leading end 2 over the cylindrical part 26 of the suction bar 23 and up onto the locating and striking face 8, the holes 24 will be connected to the negative pressure source (not illustrated), with the result that the leading end 2 is retained on the face 8. Thereupon, the conveyor belt 38 is activated and begins to run over the tapered end 39s of the wedge 39, causing a double-sided sticker 16 to detach and slip forward onto the leading end 2 of the strip, to which it adheres.

The moment a predetermined minimum diameter of the depleting roll 7 is detected by sensing means (not illustrated), the blade 18 rotates toward the fixed reference surface 10 together with the restraint arm 17, which pinches and immobilizes the trailing end 5 of the strip 6 now nearing total depletion. Thereafter, with the progress of the trailing end 5 toward the tension compensating system 33 impeded and the slack gradually taken up by the retraction of the jockey rollers 32, the blade 18 completes its full travel, meeting the fixed edge 20 of the channel 19 and making a transverse cut 5*a* through the trailing end 5 of the stationary strip 6 at a point on the feed direction preceding the area of contact between the restraint bar 17 and the fixed reference surface 10. The blade 18 is returned to the intermediate position and, with the restraint bar 17 continuing to pinch the cut trailing end 5 against the fixed reference surface 10, the suction bar 23 will rotate anticlockwise (as viewed in the drawings). As the suction bar 23 reaches its travel limit, the leading end 2 of the new strip 3 enters into contact with the portion of the trailing end 5 of the depleted strip 6 lying between the restraint bar 17 and the cut 5*a*. It will be recalled that the corresponding portion of the leading end 2 carries a double-sided sticker 16, and this now causes the leading and trailing ends 2 and 5 to join together. With the splice thus effected, the blade 18 and the restraint bar 17 are returned to their respective at-rest positions and the suction bar 23 is rotated back to the receiving position. The new strip 3 is now free to advance toward the tension compensating system 33, and the jockey rollers 32 can reassume their customary distance from the fixed position rollers 31 until the next roll change is triggered. The objects stated at the outset are realized in the device 1 as described above, which is extremely simple from both the structural and the functional standpoints, and capable of ensuring efficient and trouble-free operation over time.

What is claimed is:

1. A device for automatically splicing strips decoiled from rolls of material, comprising:

a fixed reference surface over which a depleting strip can be advanced;

a movable restraint assembly capable of movement between first position in which the restraint assembly is spaced from the fixed reference surface and a second position in which the restraint assembly is moved into engagement with said fixed reference surface so as to hold a trailing portion of the depleting strip motionless therebetween;

a cutting assembly capable of movement to effect a transverse cut through the trailing portion of the depleting strip as the depleting strip is held motionless between the fixed reference surface and the restraint means so as to form a cut end of the trailing portion of said depleting strip;

a movable retaining assembly capable of transferring a leading portion of a new strip of material from a position in which the leading portion is spaced from the trailing portion of said depleting strip to a position in which the leading portion is forced into engagement with said trailing portion adjacent said cut end; and a securing assembly for providing a securing material between said leading portion of said new strip and said trailing portion of said depleting strip so that said leading portion and said trailing portion are secured to one another after being brought into engagement by said retaining assembly .

2. A device as in claim 1, wherein said restraint assembly comprises a bar disposed transversely to the depleting strip and capable of movement parallel with respect to its own axis between an at-rest position, distanced from the fixed reference surface, and a position in which Said bar is substantially in engagement with the fixed reference surface against which the trailing portion of the depleting strip may be restrained, said cutting assembly comprising a blade disposed parallel to said bar and capable of movement between an at-rest position distanced from the fixed reference surface and a cutting position substantially in contact with the fixed reference surface, and wherein the fixed reference surface has a channel disposed transversely to the depleting strip that provides an edge on said fixed reference surface designed to function as a fixed blade with which the blade of the cutting assembly is caused to interact when effecting the transverse cut through the trailing portion of the depleting strip.

3. A device as in claim 2, wherein the bar of the restraint assembly and the blade of the cutting assembly are rigidly associated with respective sets of arms pivotable about a common axis disposed parallel to the axes of the bar and the blade, in such a manner that the blade can be displaced by the respective arms by use of first transmission means between the relative at-rest position, the cutting position and a further intermediate position, and the bar can be displaced by the respective arms by use of second transmission means between the relative at-rest position and the restraint position, and maintained in the restraint position while the blade is caused by the first transmission means to pass from the intermediate position to the cutting position and thereafter from the cutting position back toward the at-rest position.

4. A device as in claim 1, wherein the fixed reference surface has a channel disposed transversely to the depleting strip that provides an edge on said fixed reference surface designed to function as a fixed blade with which the blade of the cutting assembly is caused to interact, the retaining assembly has a locating and striking face on which the leading portion of the new strip may be positioned, and said locating and striking face being movable toward said fixed reference surface at a position adjacent the edge of the channel so as to bring the leading portion of the new strip into engagement with the trailing portion of the depleting strip.

5. A device as in claim 1, wherein said retaining assembly includes a suction bar disposed transversely to the new strip, said suction bar having holes emerging into the locating and striking surface and connected to a source of negative pressure.

6. A device as in claim 1, wherein said securing assembly comprises means by which to supply said securing material.

7. A device as in claim 6, wherein said securing assembly comprises at least one nozzle from which said securing material in the form of an adhesive material can be dispensed.

8. A device as in claim 6, wherein said securing assembly comprises means by which to distribute said securing material in the form of double sided stickers between said leading portion as the new strip and said trailing portion of the depleting strip.

9. A device as in claim 6, wherein said securing assembly comprises applicator means by which said securing material in the form of an adhesive material of a paste consistency can be spread directly onto the leading end of the new strip to be secured with the trailing end of the depleting strip.

10. A device as in claim 1, wherein said securing assembly comprises heating means for heating said leading portion of the new strip and the trailing portion of the depleting strip, wherein said strips comprise a heat activated adhesive substance as said securing material.

11. A method for splicing strips of material, comprising the steps of:

pivotally moving a movable restraint assembly about a predetermined axis from a first position in which it is spaced from a reference surface to a second position in which the restraint assembly is moved into engagement with the reference surface so as to cause a trailing portion of a depleting strip to be secured therebetween;

pivotally moving a cutting blade about said predetermined axis from an at-rest position to an intermediate position and from said intermediate position to a cutting position so as to cut said trailing portion from a remainder of said depleting strip while said restraint assembly is in said second position and said trailing portion remains secured between said restraint assembly and said reference surface;

moving a retaining assembly to transfer a leading portion of a new strip of material from a position in which the leading portion is spaced from the cut and secured trailing portion of the depleting strip to a position in which the leading portion is forced into engagement with said cut and secured trailing portion of the depleting strip; and securing said cut and secured trailing portion of the depleting strip to the leading end of said new strip.

* * * * *